US011779050B2

(12) United States Patent
Macko

(10) Patent No.: US 11,779,050 B2
(45) Date of Patent: Oct. 10, 2023

(54) E-VAPOR DEVICE INCLUDING PUNCTURE DEVICE AND SEALED PACKET OF PRE-VAPOR FORMULATION

(71) Applicant: Altria Client Services LLC, Richmond, VA (US)

(72) Inventor: Jason Andrew Macko, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 280 days.

(21) Appl. No.: 16/458,555

(22) Filed: Jul. 1, 2019

(65) Prior Publication Data

US 2019/0320722 A1 Oct. 24, 2019

Related U.S. Application Data

(63) Continuation of application No. 14/955,701, filed on Dec. 1, 2015, now Pat. No. 10,412,995.

(51) Int. Cl.

| | |
|---|---|
| ***A24F 40/42*** | (2020.01) |
| ***A24F 40/10*** | (2020.01) |
| ***H05B 1/02*** | (2006.01) |
| ***H05B 3/00*** | (2006.01) |

(52) U.S. Cl.

CPC ..... *A24F 40/42* (2020.01); *H05B 1/0244* (2013.01); *H05B 3/0014* (2013.01); *A24F 40/10* (2020.01)

(58) Field of Classification Search

CPC ..... A24F 40/42; H05B 1/0244
USPC ..... 131/328
See application file for complete search history.

(56) References Cited

U.S. PATENT DOCUMENTS

| | | | |
|---|---|---|---|
| 4,083,372 | A | 4/1978 | Boden |
| 5,881,719 | A | 3/1999 | Gottenauer et al. |
| 6,102,036 | A | 8/2000 | Slutsky et al. |
| 7,578,298 | B2 | 8/2009 | Karies et al. |
| 8,047,204 | B2 | 11/2011 | Sullivan et al. |

(Continued)

FOREIGN PATENT DOCUMENTS

| | | | |
|---|---|---|---|
| CN | 201029436 | Y | 3/2008 |
| CN | 101912654 | A | 12/2010 |

(Continued)

OTHER PUBLICATIONS

Russian Decision to Grant dated Dec. 19, 2019 for corresponding Russian Application No. 2018123692/12(037580).

(Continued)

*Primary Examiner* — Russell E Sparks
(74) *Attorney, Agent, or Firm* — Harness, Dickey & Pierce, P.L.C.

(57) ABSTRACT

An e-vapor device may include a housing shell configured to receive a supply packet containing a pre-vapor formulation, a mouthpiece secured to an end of the housing shell, a puncture device within the housing shell, and a heater structure within the housing shell and arranged to be in thermal contact with the pre-vapor formulation. The mouthpiece is configured to transition from a protracted position to a retracted position. The puncture device is configured to pierce the supply packet to release the pre-vapor formulation when the mouthpiece transitions to the retracted position. The heater structure is configured to vaporize the pre-vapor formulation to generate a vapor.

19 Claims, 6 Drawing Sheets

(56) References Cited

U.S. PATENT DOCUMENTS

| | | | | |
|---|---|---|---|---|
| 8,585,659 | B2 | 11/2013 | Shay | |
| 8,833,364 | B2 * | 9/2014 | Buchberger | A61K 31/465 128/202.21 |
| 8,955,522 | B1 | 2/2015 | Bowen et al. | |
| 9,132,248 | B2 * | 9/2015 | Qiu | A24F 40/53 |
| 10,369,302 | B2 * | 8/2019 | Suzuki | A61M 11/042 |
| 10,412,995 | B2 * | 9/2019 | Macko | A24F 40/42 |
| 2005/0016550 | A1 | 1/2005 | Katase | |
| 2008/0149118 | A1 | 6/2008 | Oglesby et al. | |
| 2009/0283103 | A1 | 11/2009 | Nielsen et al. | |
| 2010/0059544 | A1 | 3/2010 | Dijkstra et al. | |
| 2010/0095957 | A1 * | 4/2010 | Corbacho | A61M 15/0035 128/200.14 |
| 2011/0005535 | A1 | 1/2011 | Xiu | |
| 2012/0230659 | A1 | 9/2012 | Goodman et al. | |
| 2013/0213418 | A1 | 8/2013 | Tucker et al. | |
| 2013/0255675 | A1 | 10/2013 | Liu | |
| 2014/0144429 | A1 | 5/2014 | Wensley et al. | |
| 2014/0150785 | A1 | 6/2014 | Malik et al. | |
| 2014/0246019 | A1 | 9/2014 | Terry et al. | |
| 2014/0261486 | A1 | 9/2014 | Potter et al. | |
| 2014/0261487 | A1 * | 9/2014 | Chapman | A24F 40/42 87/6 |
| 2014/0283946 | A1 | 9/2014 | Kribs | |
| 2016/0278163 | A1 * | 9/2016 | Chen | A24F 40/485 |
| 2016/0345630 | A1 | 12/2016 | Mironov et al. | |
| 2017/0055574 | A1 | 3/2017 | Kaufman et al. | |
| 2018/0116277 | A1 | 5/2018 | Besso | |

FOREIGN PATENT DOCUMENTS

| | | | | |
|---|---|---|---|---|
| CN | 202068929 | U | 12/2011 | |
| CN | 102379458 | A | 3/2012 | |
| CN | 202335348 | U | 7/2012 | |
| CN | 203851816 | U | 10/2014 | |
| CN | 104126873 | A | 11/2014 | |
| CN | 104188113 | A | 12/2014 | |
| CN | 204070555 | U | 1/2015 | |
| CN | 104602552 | A | 5/2015 | |
| EP | 2022349 | A1 | 2/2009 | |
| EP | 2885986 | A1 | 6/2015 | |
| JP | 2009-537119 | A | 10/2009 | |
| JP | 2015-514429 | A | 5/2015 | |
| JP | 2018-528767 | A | 10/2018 | |
| WO | WO-9422510 | A1 | 10/1994 | |
| WO | WO-2013020220 | A1 | 2/2013 | |
| WO | WO-2013159245 | A1 | 10/2013 | |
| WO | WO-2014/167515 | A1 | 10/2014 | |
| WO | WO-2014194972 | A1 * | 12/2014 | A24F 40/42 |

OTHER PUBLICATIONS

Office Action for corresponding Japanese Application No. 2018-526752 dated Apr. 2, 2021 and English translation.

International Preliminary Reporton Patentability for PCT/EP2016/079342 dated Nov. 30, 2017.

Office Action for Chinese Application No. 201680064446.8 dated Aug. 3, 2020 and English translation.

About the Joyetech Ego/Ego-T/Ego-C, "https://www.myfreedomsmokes.com/tips-info/about-the-joyetech-ego-ego-t-ego-c", p. 2.

Vaping Guide, Awesome Vapor, "http://www.awesomevapor.com/vaping-guide.html", p. 5.

Nova Electronic Cigarette Guide, WetFlame, "http://www.wetflameecigs.com/nova-electronic-cigarette-guide/", p. 1.

International Search Report and Written Opinion dated Mar. 13, 2017 for International Application No. PCT/EP2016/079342.

Definition of Protract, Merriam-Webster Dictionary, https://www.merriam-webster.com/dictionary/protract.

Definition of Retract, Merriam-Webster Dictionary, https://www.merriam-webster.com/dictionary/retract.

Office Action for Chinese Application No. 201680064446.8 dated Apr. 2, 2021 and English translation.

Office Action for corresponding Japanese Application No. 2018-526752 dated Nov. 30, 2020 and English translation.

Japanese Office Action for corresponding Application No. 2018-526752, dated Aug. 30, 2021, with English translation.

CA Canadian Office Action for corresponding Application No. 3,001,079, dated Jan. 9, 2023.

* cited by examiner

E-VAPOR DEVICE INCLUDING PUNCTURE DEVICE AND SEALED PACKET OF PRE-VAPOR FORMULATION

CROSS-REFERENCE TO RELATED APPLICATION

This is a continuation under 35 U.S.C. § 120 of U.S. application Ser. No. 14/955,701, filed on Dec. 1, 2015, the contents of which is hereby incorporated by reference in its entirety.

BACKGROUND

Field

The present disclosure relates to electronic vapor devices including sealed containers of pre-vapor formulations.

Description of Related Art

Electronic vapor devices are electrically-powered articles configured to heat a pre-vapor formulation for the purpose of producing a vapor. Electronic vapor devices may also be referred to as e-vapor devices or e-vaping devices. Generally, an e-vapor device includes a reservoir configured to hold the pre-vapor formulation, a wick that is arranged in communication with the pre-vapor formulation, a heating element that is arranged in thermal proximity to the wick, and a power source configured to supply electricity to the heating element. The heating element may be in a form of a relatively thin wire that is coiled a plurality of times around the wick. When a current is supplied to the heating element during the operation of the e-vapor device, the wire undergoes resistive heating to vaporize the pre-vapor formulation in the wick to produce a vapor.

Some e-vapor devices include a first section coupled to a second section via a threaded connection. The first section may be a replaceable cartridge, and the second section may be a reusable structure. The threaded connection may be a combination of a male threaded member on the first section and a female threaded receiver on the second section (or vice versa). The first section may include an outer tube (or housing) extending in a longitudinal direction and an inner tube within the outer tube. The inner tube may be coaxially positioned within the outer tube. The second section may also include the outer tube (or housing) extending in a longitudinal direction. The e-vapor device may include a central air passage defined in part by the inner tube and an upstream seal. The reservoir may be configured to optionally include a storage medium that is operable to store the pre-vapor formulation therein. The reservoir may be contained in an outer annulus between the outer tube and the inner tube. The outer annulus is sealed by the seal at an upstream end and by a stopper at a downstream end so as to prevent leakage of the pre-vapor formulation from the reservoir. During assembly, the reservoir, pre-vapor formulation, wick, and heating element may be contained in fluidic communication with each other in the replaceable first section in a ready-to-use state, and the power source may be contained in the reusable second section. When the e-vapor device is in use, the first section may be discarded as a whole and replaced when the pre-vapor formulation therein has been depleted, while the second section may be recharged as needed and reused.

SUMMARY

An e-vapor device may include a housing shell configured to receive a supply packet containing a pre-vapor formulation, a mouthpiece secured to an end of the housing shell, a puncture device within the housing shell, and a heater structure within the housing shell and arranged to be in thermal contact with the pre-vapor formulation. The mouthpiece is configured to transition from a protracted position to a retracted position. The puncture device is configured to pierce the supply packet to release the pre-vapor formulation when the mouthpiece transitions to the retracted position. The heater structure is configured to vaporize the pre-vapor formulation to generate a vapor.

The supply packet is hermetically-sealed. In addition, the supply packet may have an annular form. The supply packet may also have accordion sidewalls that are configured to collapse when the mouthpiece transitions to the retracted position.

The mouthpiece is configured to transition irreversibly to the retracted position. The mouthpiece has a plunger portion that is configured to slide into the housing shell during the transition to the retracted position. The plunger portion is configured to lock in place when the retracted position is reached. The mouthpiece is configured to compress the supply packet and discharge the pre-vapor formulation therefrom when the mouthpiece transitions to the retracted position.

The puncture device may be in a form of a plurality of puncture pins. Each of the plurality of puncture pins may include a base portion and a pointed portion on the base portion. The pointed portion is configured to pierce the supply packet. The base portion is configured to halt a penetration of the pointed portion into the supply packet and to support the supply packet after being pierced by the pointed portion. Alternatively, the puncture device may be in a form of a porous plate with a plurality of pointed protrusions on a surface of the porous place facing the supply packet.

The e-vapor device may additionally include a spring positioned between the mouthpiece and the supply packet. The mouthpiece is configured to compress the spring when transitioning to the retracted position so as to provide a stored energy that yields a compressive force on the supply packet. In particular, the compressive force will push the supply packet against the puncture device to pierce the supply packet and to discharge the pre-vapor formulation from the supply packet. The e-vapor device may further include a diffuser plate positioned between the spring and the supply packet. The diffuser plate is configured to distribute the compressive force over a surface of the diffuser plate.

A method of improving a shelf-life of a pre-vapor formulation for an e-vapor device may include arranging a supply packet within a housing shell of the e-vapor device so as to be between a mouthpiece that is secured to an end of the housing shell and a puncture device within the housing shell. The supply packet contains the pre-vapor formulation. The mouthpiece is configured to transition from a protracted position to a retracted position. The puncture device is configured to pierce the supply packet to release the pre-vapor formulation when the mouthpiece transitions to the retracted position.

The method may also include forming the supply packet into an annular form prior to the arranging step. In addition, the method may include hermetically sealing the pre-vapor formulation within the supply packet prior to the arranging. The hermetically sealing step may include heat sealing the pre-vapor formulation within a polymer-coated metal foil. The method may also include pressing the mouthpiece to transition from the protracted position to the retracted position to activate the e-vapor device. The method may further include squeezing the supply packet with a stored energy provided by a compression of a spring so as to discharge the pre-vapor formulation based on a deformation of the supply packet caused by a decompression of the spring.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
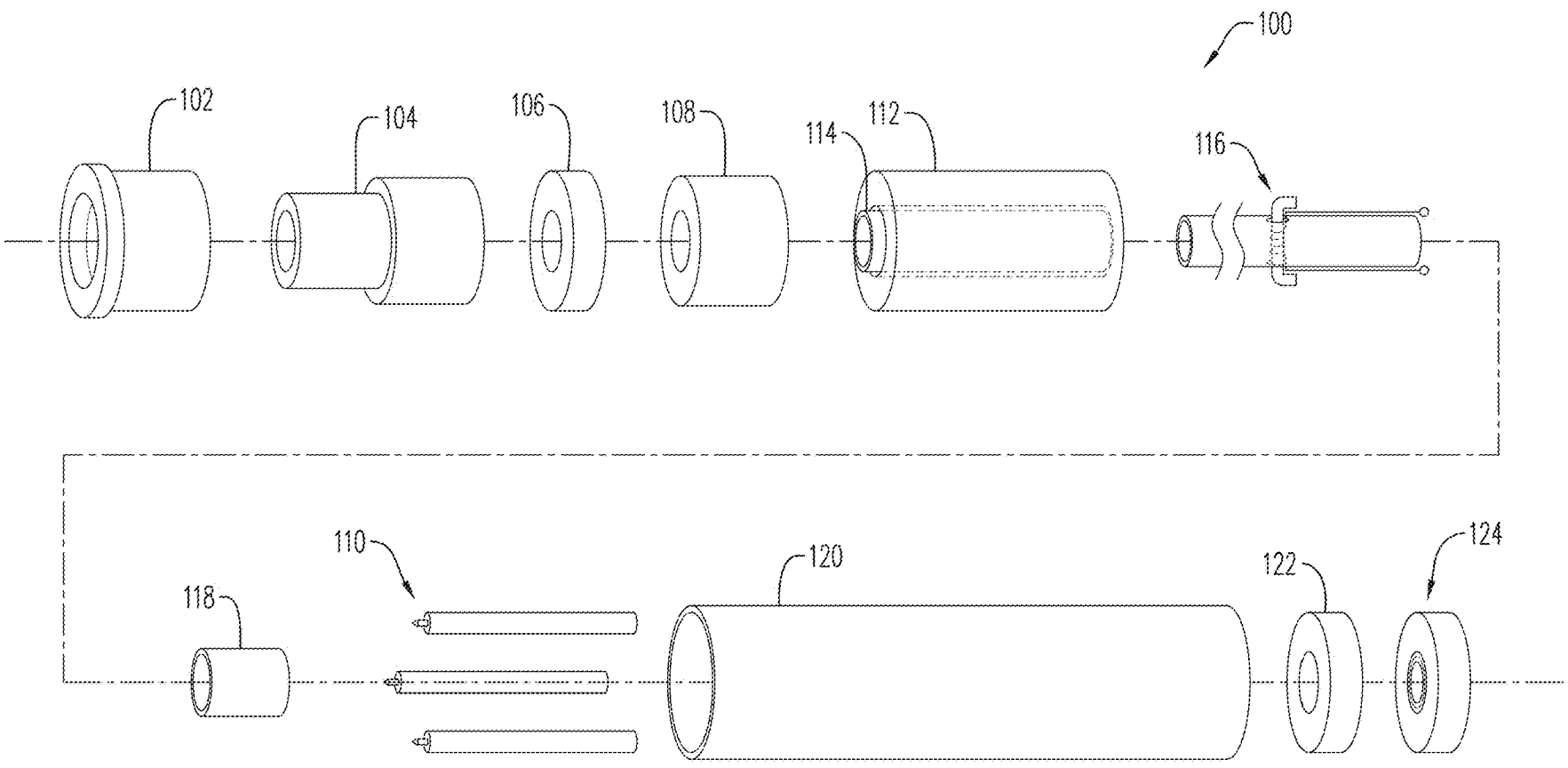
FIG. 1 is an exploded view of a vaporizer assembly of an e-vapor device according to an example embodiment.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

Example embodiments are described herein with reference to cross-sectional illustrations that are schematic illustrations of idealized embodiments (and/or intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is an exploded view of a vaporizer assembly of an e-vapor device according to an example embodiment. Referring to FIG. 1, the vaporizer assembly of the e-vapor device includes a housing shell 120 that is configured to receive and house a supply packet 108. The supply packet 108 contains a pre-vapor formulation. A pre-vapor formulation is a material or combination of materials that may be transformed into a vapor. For example, the pre-vapor formulation may be a liquid, solid, and/or gel formulation including, but not limited to, water, beads, solvents, active ingredients, ethanol, plant extracts, natural or artificial flavors, and/or vapor formers such as glycerine and propylene glycol. The supply packet 108 is hermetically-sealed so as to isolate the pre-vapor formulation therein from other internal elements and ambient air until the e-vapor device is activated for vaping by an adult vaper.

The supply packet 108 may have a shape that corresponds to an inner surface of the housing shell 120 to improve the utilization of space within the housing shell 120. In an example embodiment, when the housing shell 120 resembles a cylindrical tube, the supply packet 108 may have a cylindrical body or a disc-like body. In such an embodiment, the supply packet 108 has an outer diameter that is less than an inner diameter of the housing shell 120 as well as an outer sidewall that corresponds to the inner sidewall of the housing shell 120. For instance, the supply packet 108 may have an annular form. Such an annular form may have an opening that is configured to permit another internal element (e.g., chimney 116) of the e-vapor device to extend therethrough. In addition to the form of the supply packet 108 shown in the figures, it should be understood that the supply packet 108 may be alternatively shaped to resemble a torus.

The shape of the supply packet 108 can be varied as needed to correspond to the shape of the housing shell 120. Thus, if the housing shell 120 has a shape resembling a polygon, then the supply packet 108 may be dimensioned accordingly to correspond to such a polygon so as to enhance the fit therein and, thus, the space utilization within the housing shell 120. Alternatively, the supply packet 108 may just be provided with a versatile form that is conducive to manipulation in order to facilitate an insertion amongst the earlier-arranged elements within the housing shell 120 (rather than manufacturing the supply packet 108 to be specifically shaped to accommodate earlier-arranged elements and/or to correspond to the shape of the housing shell 120). In this regard, the supply packet 108 may be a pouch-like or bladder-type receptacle that is filled with the pre-vapor formulation and sealed prior to being manipulated and arranged within the vaporizer assembly of the e-vapor device.

The supply packet 108 is a collapsible structure that is designed to be punctured and compressed to release the pre-vapor formulation therefrom when the e-vapor device is activated. As a result, it may be beneficial for the supply packet 108 to be formed of a thin and flexible material that, when punctured and compressed, allows the supply packet 108 to be collapsed to a relatively flat form to enhance the amount of the pre-vapor formulation that is released therefrom. In addition, the supply packet 108 may be provided with preformed folding lines (e.g., in the form of grooves) to facilitate the deformation of the supply packet 108 in a more predictable and efficient manner when compressed.

The supply packet 108 may also be formed of a suitable food grade barrier that is heat-sealable. Such a food grade barrier may be a laminate structure including metal and/or plastic films. For instance, the laminate structure may be a metal film (e.g., aluminum) that is sandwiched between two plastic films (e.g., polyethylene, polypropylene, acrylic). One or more of the plastic films may also be a halogenated film (e.g., poly-chloro-tri-fluoro-ethylene (PCTFE) film), although example embodiments are not limited thereto. The flexible material of the supply packet 108 is designed to be durable enough to withstand inadvertent puncturing when the vaporizer assembly undergoes ordinary movement during the course of assembly, packaging, transporting, etc.

A mouthpiece is secured to an end of the housing shell 120. The mouthpiece is configured to transition from a protracted position to a retracted position to activate the e-vapor device. The mouthpiece may be formed of a polymer selected from the group consisting of low density polyethylene, high density polyethylene, polypropylene, polyvinylchloride, polyetheretherketone (PEEK), and combinations thereof, although other suitable materials may also be used. In an example embodiment, the mouthpiece may include a mouthpiece collar 102 and a mouthpiece plunger 104. The mouthpiece plunger 104 includes a base section and a protruding section that extends from the base section. The mouthpiece collar 102 includes a first opening, an opposing second opening (that is smaller than the first opening), and an internal lip around the second opening. For instance, the internal lip may be an orthogonal transition point between the first opening and the second opening of the mouthpiece collar 102.

The diameter of the base section of the mouthpiece plunger 104 corresponds to the first opening of the mouthpiece collar 102, while the diameter of the protruding section of the mouthpiece plunger 104 corresponds to the diameter of the smaller, opposing second opening of the mouthpiece collar 102. As a result, when the mouthpiece plunger 104 is inserted into the first opening of the mouthpiece collar 102 during assembly, the protruding section of the mouthpiece plunger 104 will pass through the opposing second opening of the mouthpiece collar 102, while the base section of the mouthpiece plunger 104 will not pass through the opposing second opening of the mouthpiece collar 102 (due to at least the internal lip within the mouthpiece collar 102 which acts as a stopper). The base section of the mouthpiece plunger 104 may abut against the internal lip of the mouthpiece collar 102 when the mouthpiece is in the protracted position.

The mouthpiece collar 102 may be inserted within the housing shell 120 and retained via a friction fit. Alternatively, an adhesive or a welding process (e.g., ultrasonic welding) may be used to join the outer sidewall of the mouthpiece collar 102 to the inner sidewall of the housing shell 120. In an example embodiment, the entire outer sidewall of the mouthpiece collar 102 may interface with a corresponding end segment of the inner sidewall of the housing shell 120. In such an arrangement, the exposed rim of the mouthpiece collar 102 may be flush or substantially even with the corresponding end of the housing shell 120.

The mouthpiece plunger 104 includes at least one outlet to allow the vapor generated within the e-vapor device to exit from the mouthpiece. In a single outlet embodiment, the outlet for the vapor may be coaxial with the central longitudinal axis of the e-vapor device. However, rather than being coaxial, the outlet may be off-axis relative to the central longitudinal axis. For instance, the outlet may be offset so as to be parallel to (rather than coinciding with) the central longitudinal axis or may be angled relative to the central longitudinal axis.

Although the mouthpiece plunger 104 is illustrated in the figures as having one outlet on the end face of the protruding section, it should be understood that a plurality of outlets (e.g., 2, 4, 6, 8) may also be provided. In a non-limiting embodiment involving a plurality of outlets, the outlets may be arranged so as to be parallel to each other. One of the outlets may also be coaxial with the central longitudinal axis of the e-vapor device, while the other outlets may be off-axis, evenly spaced around the central outlet, and optionally angled. Alternatively, all of the plurality of outlets may be arranged so as to be off-axis. The off-axis outlets may be angled to form a diverging arrangement that radiates the exiting vapor outward from the mouthpiece.

The size, shape, and position of each of the plurality of outlets on the end face of the protruding section of the mouthpiece plunger 104 may vary depending on the desired properties of the exiting vapor. For example, the size of each of the plurality of outlets may be the same or different. In a non-limiting embodiment involving outlets of two different sizes, the differently-sized outlets may be alternately arranged with each other. Additionally, the shape of the opening portion of each of the outlets may vary depending on the orientation of the channel portion of each of the outlets. For instance, when an outlet is coaxial or parallel to the central longitudinal axis of the e-vapor device, the opening portion may be circular. On the other hand, when the outlet is angled relative to the central longitudinal axis, the opening portion may be elliptical or oval-shaped.

The outlets may be angled such that droplets of unvaporized pre-vapor formulation will impact the inner surfaces thereof so as to be broken apart and/or removed from the exiting vapor. In an example embodiment, the outlets may be angled about 5 to 60 degrees with respect to the central longitudinal axis of the e-vapor device so as to remove droplets of unvaporized pre-vapor formulation and to more completely distribute the vapor. Each outlet may have a diameter of about 0.015 inches to about 0.090 inches (e.g., about 0.020 inches to about 0.040 inches or about 0.028 inches to about 0.038 inches). The number, angle, and size of the outlets can be adjusted as needed to obtain the desired resistance to draw (RTD) of the e-vapor device.

A gasket 106 is arranged within the housing shell 120 so as to be between the mouthpiece and the supply packet 108. The e-vapor device is designed such that the base section of the mouthpiece plunger 104 will press against and axially displace the gasket 106 within the housing shell 120 when the mouthpiece transitions from the protracted position to the retracted position. The gasket 106 is configured to form a seal that precludes leakage of the pre-vapor formulation from the mouthpiece when the e-vapor device is activated. In this regard, the outer sidewall of the gasket 106 is configured to interface with the inner sidewall of the housing shell 120 so as to form a substantially liquid-tight seal. The gasket 106 may also help to distribute the force exerted on the supply packet 108 more evenly when the mouthpiece plunger 104 is depressed to transition the mouthpiece to the retracted position. Furthermore, the gasket 106 may include an opening that is configured to permit another internal element (e.g., chimney 116) of the e-vapor device to extend therethrough. In such an embodiment, the inner sidewall of the gasket 106 is configured to interface with the outer sidewall of such an element so as to form a substantially liquid-tight seal.

A puncture device 110 is arranged within the housing shell 120 so as to be adjacent to the supply packet 108. The puncture device 110 is configured to pierce the supply packet 108 to release the pre-vapor formulation therein when the mouthpiece transitions to the retracted position. The puncture device 110 may be in a form of a plurality of puncture pins. The puncture pins may be oriented so as to be parallel to the longitudinal axis of the e-vapor device. Additionally, the puncture pins may be evenly spaced from each other along the inner sidewall of the housing shell 120. Each of the plurality of puncture pins may include a base portion and a pointed portion on the base portion. The pointed portion of each of the puncture pins is configured to pierce the supply packet 108 when the e-vapor device is activated. The base portion of each of the puncture pins is configured to halt a penetration of the pointed portion into the supply packet 108 and to support the supply packet 108 after being pierced by the pointed portion. In this regard, the base portion of each of the puncture pins may be an orthogonal surface (relative to the surface of the pointed portion) that functions as a stopper in connection with the piercing of the supply packet 108.

Although the puncture device 110 is shown as being in a form of three puncture pins, it should be understood that example embodiments are not limited thereto. For instance, the puncture device 110 may be in a form of four, five, six, or more puncture pins. Furthermore, the puncture pins may be connected to each other via one or more wires to allow the puncture device 110 to be wrapped around one or more internal elements (e.g., outer absorbent material 112, inner absorbent material 114, and/or chimney 116) prior to being inserted into the housing shell 120.

Alternatively, the puncture device 110 may be in a form of a porous plate with a plurality of pointed protrusions on a surface of the porous place facing the supply packet 108. The porous plate may be a perforated sheet or a grid-like structure. The porous plate may include an opening that is configured to permit another internal element (e.g., chimney 116) of the e-vapor device to extend therethrough. The porous plate may be supported by an internal ledge within the housing shell 120. In another non-limiting embodiment, the puncture device 110 may also include legs secured to an underside of the porous plate such that the legs are configured to brace against a bottom of the vaporizer assembly 100.

A heater structure is disposed within the housing shell 120 and arranged to be in thermal contact with the pre-vapor formulation during vaping. In particular, the heater structure is configured to vaporize the pre-vapor formulation to generate a vapor during vaping. The chimney 116 is configured to direct the generated vapor to the one or more outlets of the mouthpiece during vaping. An end of the chimney 116 (that will be adjacent to the mouthpiece) is inserted into a chimney collar 118. The chimney 116 may include a through-hole, wherein a wick is arranged to extend through opposing sidewalls of the chimney 116. The heater structure is positioned in thermal proximity to the wick and is designed to undergo resistive heating when a voltage is applied. Although not specifically labeled in the drawings, it should be understood that the heater structure may include a heating wire, crimps, supply wire, solder, and other associated elements. The e-vapor device may also include at least one air inlet that is configured to deliver air to the central air passage within the chimney 116.

An inner absorbent material 114 is wrapped around the chimney 116 so as to contact the wick. In an example embodiment, the inner absorbent material 114 may be a high-density gauze. An outer absorbent material 112 is wrapped around the inner absorbent material 114. In an example embodiment, the outer absorbent material 112 may be a low-density gauze. During the operation of the e-vapor device, the outer absorbent material 112 and the inner absorbent material 114 may be moistened (e.g., saturated) with the pre-vapor formulation from the supply packet 108. Thus, outer absorbent material 112 and the inner absorbent material 114 (along with the annular space between the chimney 116 and the housing shell 120) may act as a reservoir for the pre-vapor formulation. From the reservoir, the pre-vapor formulation is drawn into the wick (which extends through the chimney 116) and is heated by the heater structure within the chimney 116 during vaping to generate a vapor.

The wick may be constructed of a fibrous and flexible material. In an example embodiment, the wick may include at least one filament having a capacity to draw a pre-vapor formulation into the wick via capillary action due to the absorptive nature of the at least one filament. In another instance, the wick may include a bundle of filaments (e.g., glass or ceramic filaments) having a capacity to draw a pre-vapor formulation into the wick via capillary action as a result of the interstitial spacing between the filaments. In another instance, the wick may include a bundle comprising a group of windings of filaments (e.g., three of such windings).

The wick may extend through opposing openings in the sidewall of the chimney 116 such that the end portions of the wick are in contact with the pre-vapor formulation in the reservoir. The filaments of the wick may be generally aligned in a direction transverse to the longitudinal direction of the e-vapor device, although example embodiments are not limited thereto. The wick may include filaments having a cross-section that is generally cross-shaped, clover-shaped, Y-shaped, or in any other suitable shape. The capillary properties of the wick, combined with the properties of the pre-vapor formulation, can be tailored to ensure that the wick will be adequately wet in the appropriate area of the heater structure to avoid overheating. The wick (along with the outer absorbent material 112 and/or the inner absorbent material 114) may be constructed from an alumina ceramic. Alternatively, the wick may include glass fibers, while the outer absorbent material 112 and/or the inner absorbent material 114 may include a cellulosic material or polyethylene terephthalate.

The heater structure may be a loop-type arrangement (e.g., helix) surrounding the wick. Examples of suitable electrically resistive materials for the heater structure include titanium, zirconium, tantalum, and metals from the platinum group. Examples of suitable metal alloys include nickel-, cobalt-, chromium-, aluminum-, titanium-, zirconium-, hafnium-, niobium-, molybdenum-, tantalum-, tungsten-, tin-, gallium-, manganese-, and iron-containing alloys (e.g., stainless steel). In addition, super-alloys based on nickel, iron, and cobalt may also be suitable. In an example embodiment, the heater structure may include nickel aluminides, a material with a layer of alumina on the surface, iron aluminides, and other composite materials. The electrically resistive material may optionally be embedded in, encapsulated, or coated with an insulating material or vice-versa, depending on the kinetics of energy transfer and the external physicochemical properties required. In a non-limiting embodiment, the heater structure comprises at least one material selected from the group consisting of stainless steel, copper, copper alloys, nickel-chromium alloys, super-alloys, and combinations thereof. In another non-limiting embodiment, the heater structure includes nickel-chromium alloys or iron-chromium alloys. Furthermore, the heater structure may include a ceramic portion having an electrically resistive layer on an outside surface thereof. A higher resistivity for the heater structure lowers the current draw or load on the power supply (e.g., battery).

The heater structure may directly heat the pre-vapor formulation in the wick by thermal conduction. Alternatively, the heat from the heater structure may be indirectly conducted to the pre-vapor formulation by means of a heat conductive element or the heater structure may transfer the heat to the incoming ambient air that is drawn through the e-vapor device during use, which in turn heats the pre-vapor formulation by convection.

When assembled, the vaporizer assembly 100 will be connected to a battery assembly. In particular, a power supply in the battery assembly is configured to be operably connected to the heater structure in the vaporizer assembly 100 to apply a voltage across the heater structure. The power supply may include a battery arranged such that the anode is downstream from the cathode. A battery anode connector may contact the downstream end of the battery. The heater structure may be connected to the battery by two spaced apart electrical leads. The connection between the end portions of the heater structure and the electrical leads are relatively conductive and temperature resistant, while the heater structure is relatively resistive so that heat generation occurs primarily along the heater structure and not at the contacts.

The battery may be a lithium-ion battery or one of its variants (e.g., a lithium-ion polymer battery). The battery may also be a nickel-metal hydride battery, a nickel-cadmium battery, a lithium-manganese battery, a lithium-cobalt battery, or a fuel cell. When vaping, the e-vapor device is usable until the energy in the power supply is depleted, after which the power supply will need to be replaced. Alternatively, the power supply may be rechargeable and include circuitry allowing the battery to be chargeable by an external charging device. In this rechargeable embodiment, the circuitry, when charged, provides power for a desired or pre-determined number of puffs, after which the circuitry must be re-connected to an external charging device.

The e-vapor device may also include control circuitry including a puff sensor. The puff sensor is configured to sense an air pressure drop and to initiate the application of a voltage from the power supply to the heater structure. The control circuitry may include a heater activation light that is configured to glow when the heater structure is activated. The heater activation light may include an LED and may be arranged at an upstream end of the e-vapor device so that the heater activation light takes on the appearance of a burning coal during a puff. Additionally, the heater activation light can be arranged to be visible to the adult vaper. Furthermore, the heater activation light can be utilized for e-vapor system diagnostics. The heater activation light can also be configured such that the adult vaper can activate and/or deactivate the heater activation light for privacy, such that, if desired, the heater activation light would not activate during vaping.

When the puff sensor detects a puff by an adult vaper, the control circuitry may automatically supply power to the heater structure with a maximum, time-period limiter. Alternatively, the control circuitry may include a manually-operable switch for an adult vaper to initiate a puff. The time-period of the supply of electric current to the heater structure may be pre-set depending on the amount of pre-vapor formulation desired to be vaporized, and the control circuitry may be programmable for this purpose. The control circuitry may continue to supply power to the heater structure as long as the puff sensor detects a pressure drop.

When activated, the heater structure may heat a portion of the wick surrounded by the heater structure for less than about 10 seconds (e.g., less than about 7 seconds). The power cycle (or maximum puff length) can range from about 2 seconds to about 10 seconds (e.g., about 3 seconds to about 9 seconds, about 4 seconds to about 8 seconds, or about 5 seconds to about 7 seconds).

A fibrous material (e.g., cotton, polyethylene, polyester, rayon, and combinations thereof) may be used to form the outer absorbent material 112, the inner absorbent material 114, and/or the wick. The fibers of the fibrous material may have a diameter ranging in size from about 6 microns to about 15 microns (e.g., about 8 microns to about 12 microns or about 9 microns to about 11 microns). Also, the fibers may be sized to be irrespirable and can have a cross-section with a Y shape, cross shape, clover shape, or any other suitable shape. Additionally, instead of a fibrous material, a sintered material, a porous material, or a foamed material may be used. Furthermore, it should be understood that the outer absorbent material 112 and/or the inner absorbent material 114 may be omitted so that the reservoir can be provided as a relatively vacant space for holding the pre-vapor formulation.

The pre-vapor formulation has a boiling point suitable for use in the e-vapor device. In particular, if the boiling point is too high, then the heater structure may not be able to adequately vaporize the pre-vapor formulation in the wick.

Conversely, if the boiling point is too low, then the pre-vapor formulation may prematurely vaporize without the heater structure even being activated. In an example embodiment, the pre-vapor formulation may be a tobacco-containing material including volatile tobacco flavor compounds which are released from the pre-vapor formulation upon heating. The pre-vapor formulation may also be a tobacco flavor containing material and/or a nicotine-containing material. Alternatively, or in addition thereto, the pre-vapor formulation may include a non-tobacco material.

Figure 2:
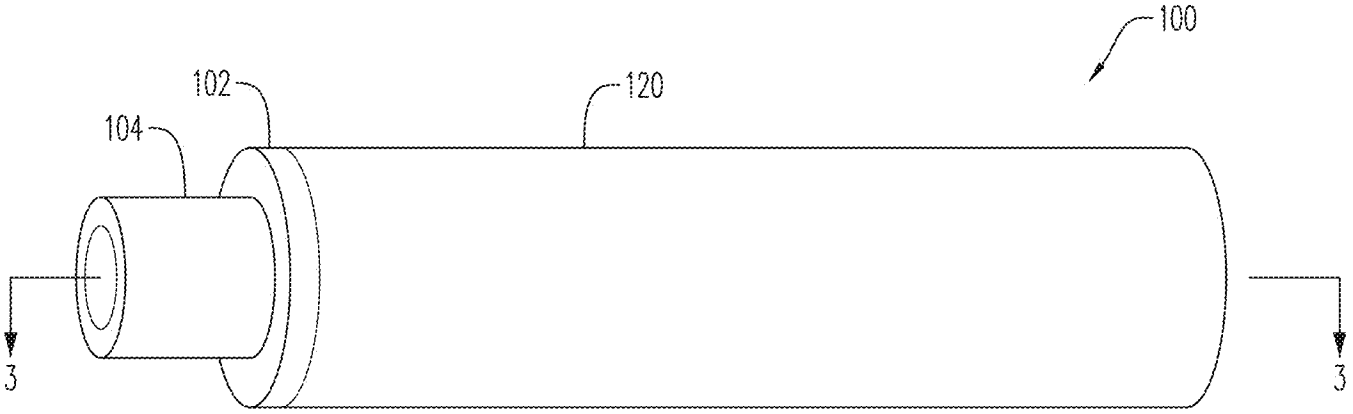
FIG. 2 is a perspective view of the vaporizer assembly of FIG. 1 when assembled and when the mouthpiece is in a protracted position.

FIG. 2 is a perspective view of the vaporizer assembly of FIG. 1 when assembled and when the mouthpiece is in a protracted position. Referring to FIG. 2, the mouthpiece collar 102 may be inserted into the housing shell 120 such that only the rim of the mouthpiece collar 102 is visible. The mouthpiece plunger 104 may protrude outward through the mouthpiece collar 102 such that the base section of the mouthpiece plunger 104 abuts against the internal lip of the mouthpiece collar 102. The internal lip of the mouthpiece collar 102 functions as a stopper for the mouthpiece plunger 104. As a result, under ordinary circumstances, the mouthpiece plunger 104 cannot be protracted so as to be separated from the mouthpiece collar 102. Instead, the mouthpiece plunger 104, when assembled, is configured to remain in the protracted position until it is pressed to activate the e-vapor device. In addition, it should be understood that the vaporizer assembly 100 will be connected to a battery assembly prior to activation and vaping. The connection may be a threaded connection, a bayonet connection, a snap-fit connection, or a magnetic connection, although example embodiments are not limited thereto.

Figure 3:
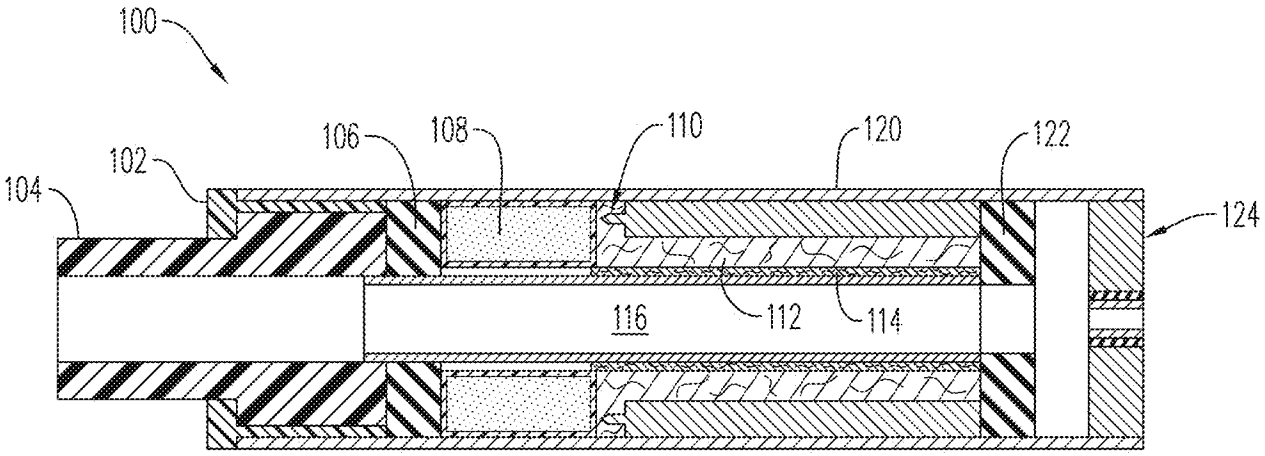
FIG. 3 is a cross-sectional view of the vaporizer assembly of FIG. 2, taken along line 3-3.

FIG. 3 is a cross-sectional view of the vaporizer assembly of FIG. 2, taken along line 3-3. Referring to FIG. 3, the illustration of the chimney collar 118 and various other elements (e.g., wick, heating wire) have been omitted to provide a clearer view of the internal structure/mechanism of the vaporizer assembly 100. When the vaporizer assembly 100 is assembled, the interior of the housing shell 120 is filled with elements such that the mouthpiece plunger 104 protrudes outward through the mouthpiece collar 102. In particular, the supply packet 108 may be arranged between the mouthpiece plunger 104 and the puncture device 110 such that the mouthpiece plunger 104 cannot move inward without pressing the supply packet 108 against the puncture device 110, which would result in the piercing of the supply packet 108 and the release of the pre-vapor formulation therein.

The mouthpiece plunger 104 is configured to slide through the mouthpiece collar 102 and into the housing shell 120 during the transition to the retracted position. The mouthpiece is configured to transition irreversibly from the protracted position to the retracted position. In an example embodiment, when pressed inward by an adult vaper, the mouthpiece plunger 104 is configured to lock in place when the retracted position is reached. For instance, the side surface of the base section of the mouthpiece plunger 104 may be provided with angled teeth, while the inner sidewall of the mouthpiece collar 102 may be provided with a pawl or corresponding recesses so as to form a ratchet arrangement. Conversely, the inner sidewall of the mouthpiece collar 102 may be provided with angled teeth, while the side surface of the base section of the mouthpiece plunger 104 may be provided with a pawl or corresponding recesses so as to form a ratchet arrangement. The angled teeth may be right-angled teeth which are oriented such that the angled side facilitates a retraction of the mouthpiece plunger 104 through the mouthpiece collar 102 and into the housing shell 120, while the perpendicular side precludes a protraction of the mouthpiece plunger 104 after a retraction has occurred. Thus, the mouthpiece plunger 104 may be configured to undergo a one-way incremental retraction through the mouthpiece collar 102 and into the housing shell 120. The incremental movement of the mouthpiece plunger 104 to the retracted position may also be accompanied by one or more audible clicks.

Figure 4:
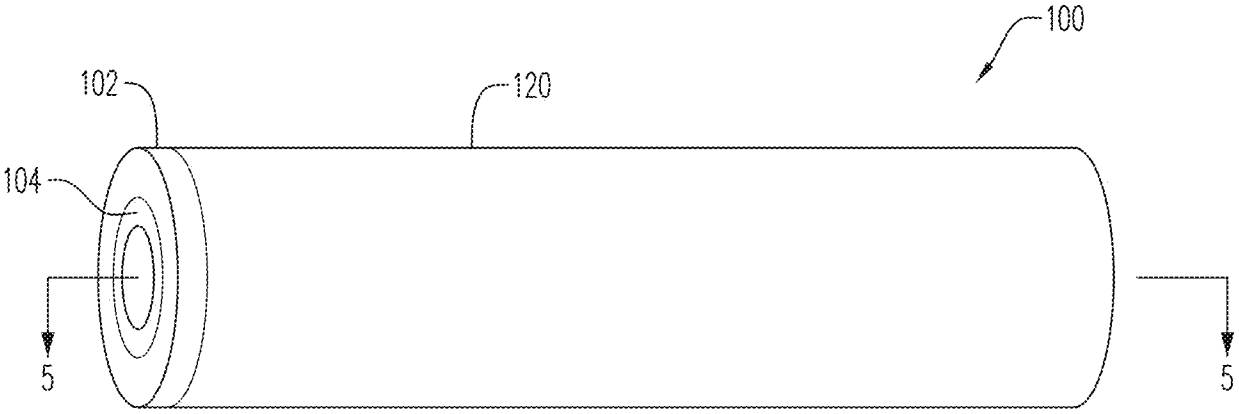
FIG. 4 is a perspective view of the vaporizer assembly of FIG. 1 when assembled and when the mouthpiece is in a retracted position.

FIG. 4 is a perspective view of the vaporizer assembly of FIG. 1 when assembled and when the mouthpiece is in a retracted position. Referring to FIG. 4, the end face of the protruding section of the mouthpiece plunger 104 may be flush (or substantially flush) with the rim of the mouthpiece collar 102 when the mouthpiece is in the retracted position. The mouthpiece plunger 104 is also configured to lock in place (e.g., via a ratchet arrangement) so as to preclude a return to the protracted position once the retracted position has been reached. The locking of the mouthpiece plunger 104 may be accompanied by a distinct audible sound (e.g., click) so as to notify an adult vaper that the retracted position has been reached and that further pressing is unnecessary.

Figure 5:
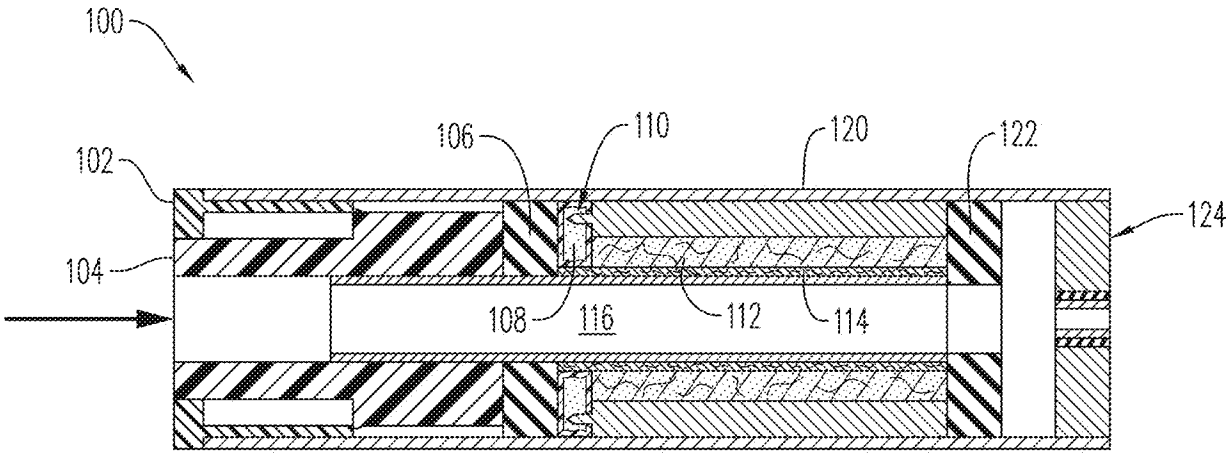
FIG. 5 is a cross-sectional view of the vaporizer assembly of FIG. 4, taken along line 5-5.

FIG. 5 is a cross-sectional view of the vaporizer assembly of FIG. 4, taken along line 5-5. Referring to FIG. 5, the mouthpiece is configured to compress the supply packet 108 and discharge the pre-vapor formulation therefrom when the mouthpiece transitions to the retracted position. In particular, the e-vapor device is activated when an adult vaper presses the mouthpiece plunger 104 into the mouthpiece collar 102, thereby transitioning the mouthpiece from the protracted position to the retracted position. By transitioning the mouthpiece to the retracted position, the mouthpiece plunger 104 will, in effect, push the supply packet 108 into the puncture device 110 so as to pierce the supply packet 108 while squeezing the pre-vapor formulation therefrom. In an example embodiment, the supply packet 108 may have accordion sidewalls that are configured to collapse during the release of the pre-vapor formulation when the mouthpiece transitions to the retracted position. The pre-vapor formulation that is released from the pierced supply packet 108 will be absorbed by the outer absorbent material 112 and the inner absorbent material 114 as well as the wick which is in fluidic communication therewith. During vaping, as the pre-vapor formulation in the wick is heated by the heater structure to generate a vapor, more pre-vapor formulation in the outer absorbent material 112 and the inner absorbent material 114 will be drawn into the wick via capillary action until the supply of pre-vapor formulation is depleted or otherwise insufficient to adequately saturate the wick.

Figure 6:
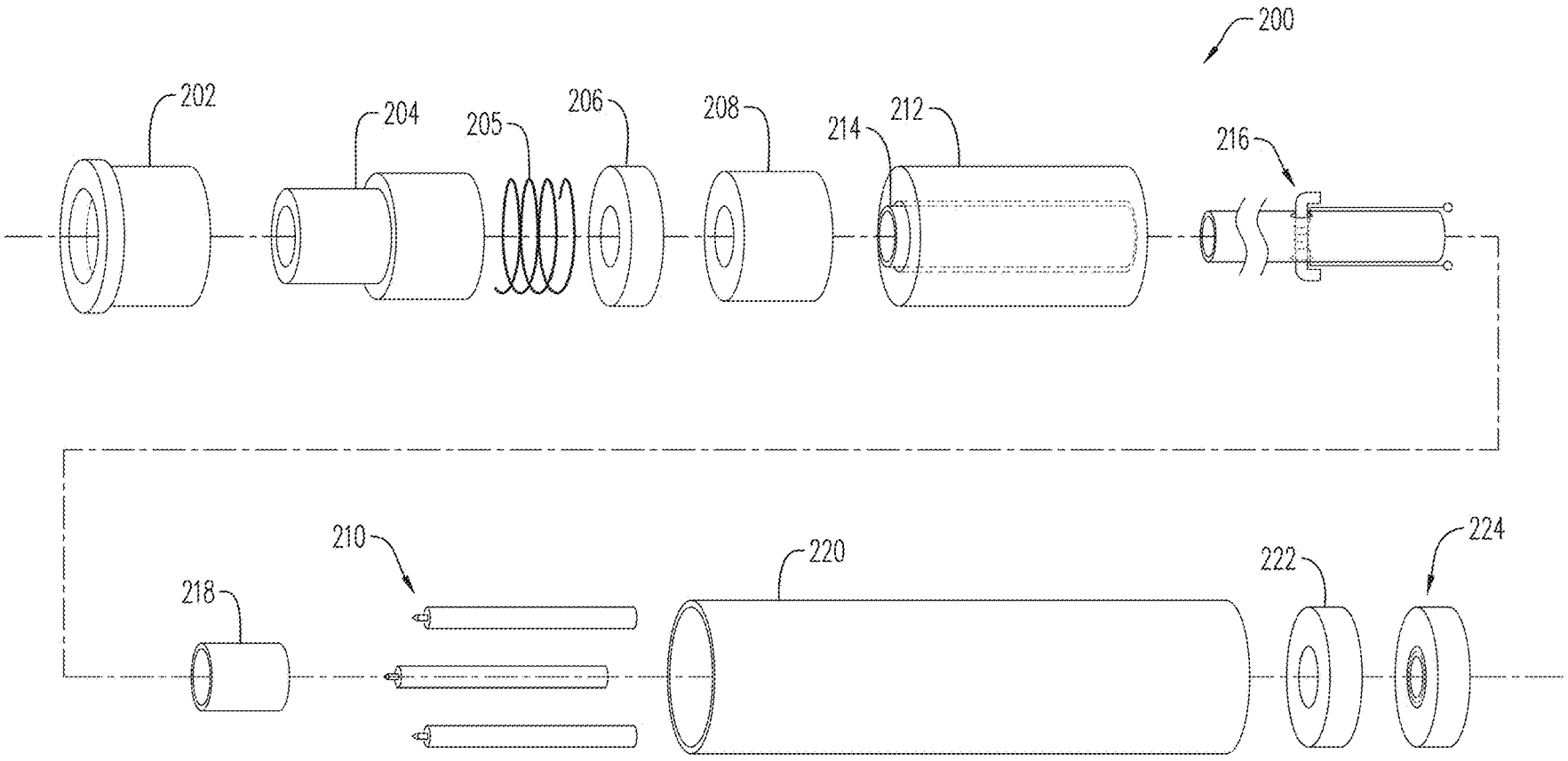
FIG. 6 is an exploded view of a vaporizer assembly of an e-vapor device according to another example embodiment.

FIG. 6 is an exploded view of a vaporizer assembly of an e-vapor device according to another example embodiment. With the exception of the spring 205, the elements of the vaporizer assembly of FIG. 6 may be as described in connection with the elements of the vaporizer assembly of FIG. 1. In particular, the mouthpiece collar 202 of FIG. 6 may correspond to the mouthpiece collar 102 of FIG. 1. The mouthpiece plunger 204 of FIG. 6 may correspond to the mouthpiece plunger 104 of FIG. 1. The gasket 206 of FIG. 6 may correspond to the gasket 106 of FIG. 1. The supply packet 208 of FIG. 6 may correspond to the supply packet 108 of FIG. 1. The puncture device 210 of FIG. 6 may correspond to the puncture device 110 of FIG. 1. The outer absorbent material 212 of FIG. 6 may correspond to the outer absorbent material 112 of FIG. 1. The inner absorbent material 214 of FIG. 6 may correspond to the inner absorbent material 114 of FIG. 1. The chimney 216 of FIG. 6 may correspond to the chimney 116 of FIG. 1. The chimney collar 218 of FIG. 6 may correspond to the chimney collar 118 of FIG. 1. The housing shell 220 of FIG. 6 may correspond to the housing shell 120 of FIG. 1. The gasket 222 of FIG. 6 may correspond to the gasket 122 of FIG. 1. The anode/cathode 224 of FIG. 6 may correspond to the anode/cathode 124 of FIG. 1.

The spring 205 has an outer diameter that is more than the outer diameter of the chimney 216 but less than the inner diameter of the housing shell 220. In an example embodiment, the spring 205 may have an outer diameter that is about 80-95% of the inner diameter of the housing shell 220. In such an instance, the spring 205 can be compressed freely without abrading against the inner sidewall of the housing shell 220 (or at least without encountering an undesirable level of friction from the inner sidewall of the housing shell 220). Although the spring 205 in FIG. 6 is illustrated as having open ends, it should be understood that example embodiments are not limited thereto. For instance, the ends of the spring 205 may be closed and square, closed and ground, or double closed. In addition, the outer diameter, wire diameter, wire material, free length, and number of coils of the spring 205 may be selected such that the spring constant will be of an appropriate magnitude to allow the spring 205 to experience a compression during activation of the e-vapor device followed by an expansion that causes the pre-vapor formulation to be squeezed from the pierced supply packet 208. In a non-limiting embodiment, the spring 205 may have a spring constant ranging from about 0.1 to 0.4 N/mm.

When the vaporizer assembly of FIG. 6 is assembled, the spring 205 will be positioned between the mouthpiece and the supply packet 208. The mouthpiece is configured to compress the spring 205 when transitioning to the retracted position so as to provide a stored energy that yields a compressive force on the supply packet 208. In particular, the compressive force from the spring 205 will push the supply packet 208 against the puncture device 210 to pierce the supply packet 208 and to discharge the pre-vapor formulation from the supply packet 208.

A diffuser plate may be positioned between the spring 205 and the supply packet 208. The diffuser plate is configured to distribute the compressive force from the spring 205 over a surface of the diffuser plate so that a more even pressure can be applied to the supply packet 208 to squeeze the pre-vapor formulation therefrom. The diffuser plate and/or mouthpiece plunger 204 may be provided with a recess (e.g., annular recess) to receive the spring 205 in order to help hold the spring 205 in place, regardless of the orientation of the vaporizer assembly. In an example embodiment, the diffuser plate may be in the form of the gasket 206 shown in FIG. 6. The gasket 206 is configured to shift/slide in an axial direction along an inner sidewall of the housing shell 220 so as to push against the supply packet 208 (in response to the subsequent expansion of the compressed spring 205 following the retraction of the mouthpiece plunger 204 into the mouthpiece collar 202). The gasket 206 is also configured to form a seal that precludes a leakage of the pre-vapor formulation from the mouthpiece. In this regard, the outer sidewall of the gasket 206 is configured to interface with the inner sidewall of the housing shell 220 so as to form a substantially liquid-tight seal.

Figure 7:
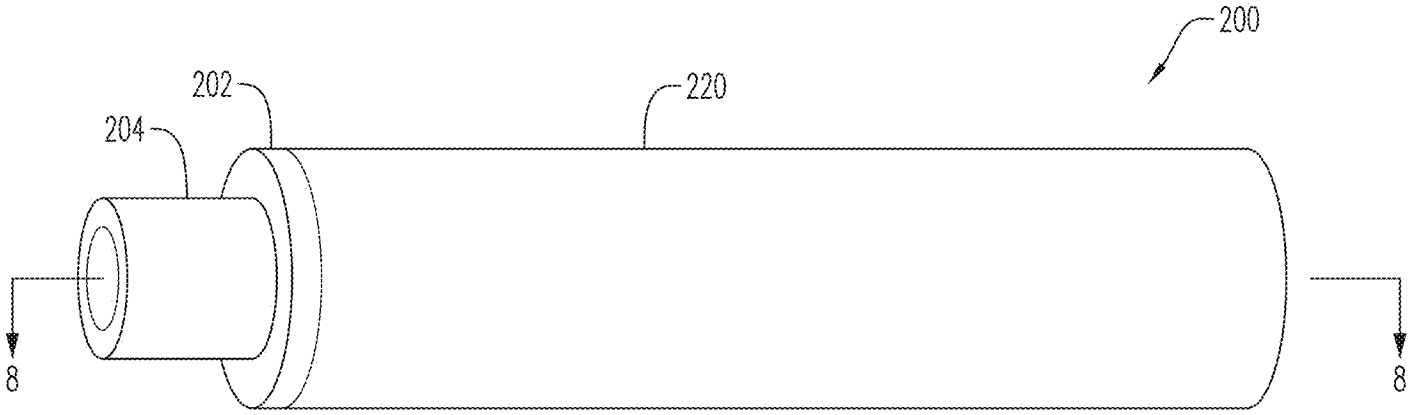
FIG. 7 is a perspective view of the vaporizer assembly of FIG. 6 when assembled and when the mouthpiece is in a protracted position.
Figure 8:
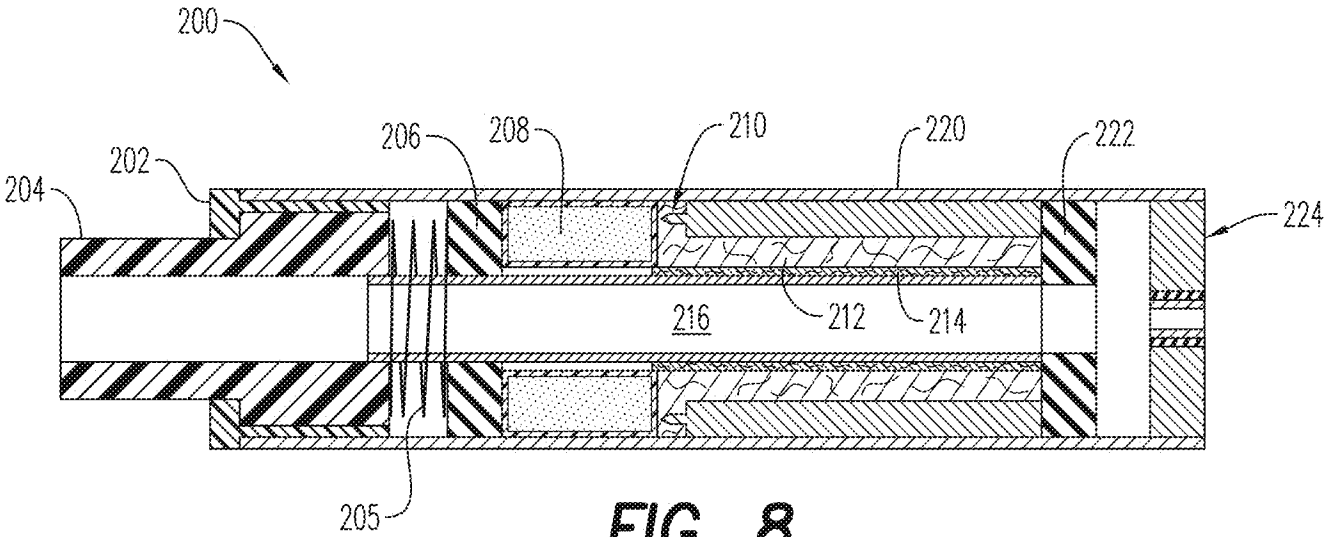
FIG. 8 is a cross-sectional view of the vaporizer assembly of FIG. 7, taken along line 8-8.

FIG. 7 is a perspective view of the vaporizer assembly of FIG. 6 when assembled and when the mouthpiece is in a protracted position. FIG. 8 is a cross-sectional view of the vaporizer assembly of FIG. 7, taken along line 8-8. With the exception of the presence of the spring 205, the vaporizer assembly 200 of FIGS. 7-8 may be as described in connection with the vaporizer assembly 100 of FIGS. 2-3. Also, referring to FIG. 8, the illustration of the chimney collar 218 and various other elements (e.g., wick, heating wire) have been omitted to provide a clearer view of the internal structure/mechanism of the vaporizer assembly 200. When the vaporizer assembly 200 is assembled, the spring 205 therein will be uncompressed until an adult vaper presses the mouthpiece plunger 204 into the mouthpiece collar 202 to activate the e-vapor device. Alternatively, it is possible for the vaporizer assembly 200 to be assembled such that the spring 205 is already slightly compressed (e.g., compressed less than 5% of its free length). In such an embodiment where the vaporizer assembly 200 is assembled such that the spring 205 is already slightly compressed prior to activation of the e-vapor device, the level of stored energy from the slight compression should be relatively low so as to be inadequate to cause the supply packet 208 to be prematurely pierced by the puncture device 210.

Figure 9:
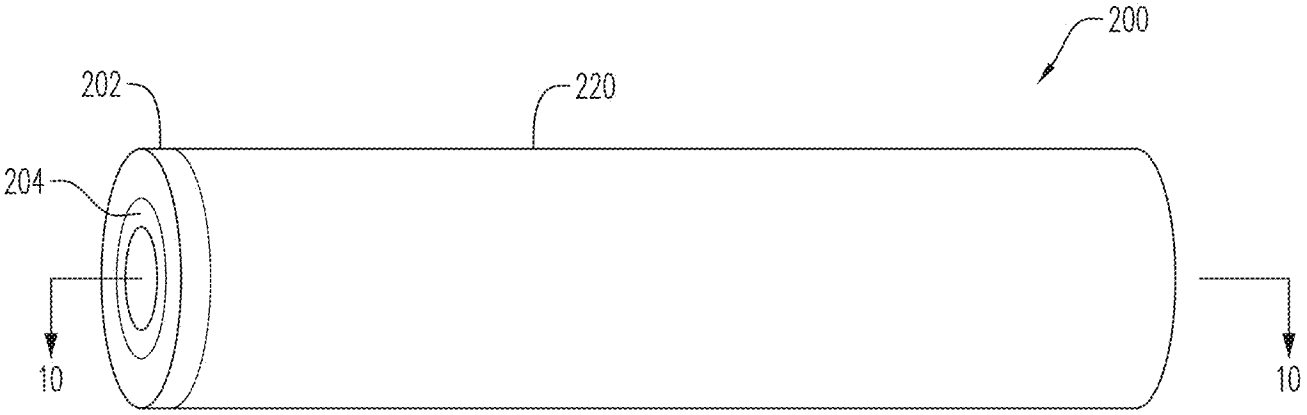
FIG. 9 is a perspective view of the vaporizer assembly of FIG. 6 when assembled and when the mouthpiece is in a retracted position.
Figure 10:
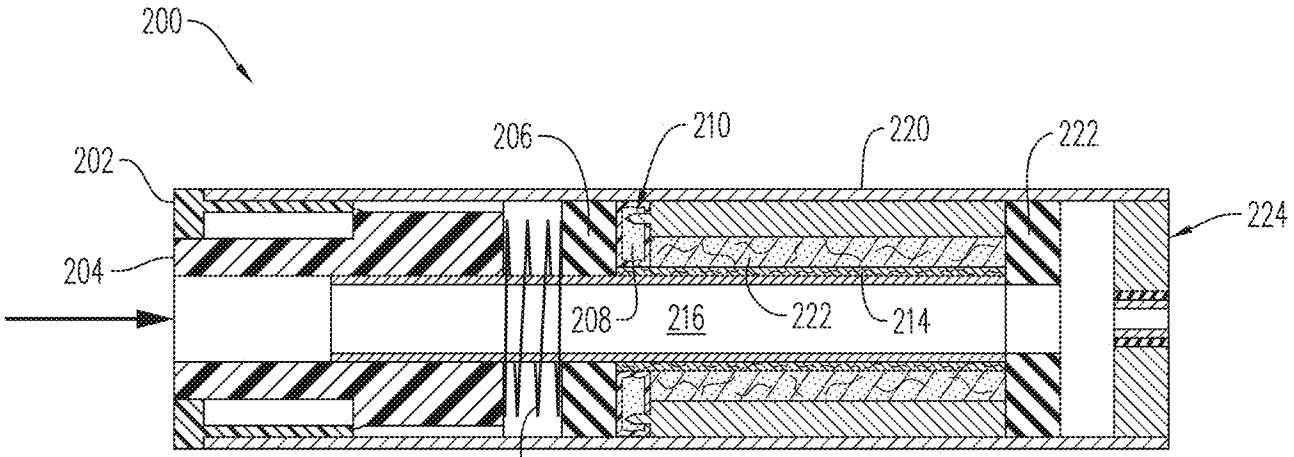
FIG. 10 is a cross-sectional view of the vaporizer assembly of FIG. 9, taken along line 10-10.

FIG. 9 is a perspective view of the vaporizer assembly of FIG. 6 when assembled and when the mouthpiece is in a retracted position. FIG. 10 is a cross-sectional view of the vaporizer assembly of FIG. 9, taken along line 10-10. Referring to FIGS. 9-10, the mouthpiece is configured to compress the spring 205 when an adult vaper presses the mouthpiece plunger 204 into the mouthpiece collar 202 to activate the e-vapor device. An audible click may be produced when the mouthpiece plunger 204 locks in place (e.g., via a ratchet arrangement), thereby indicating that the mouthpiece has properly transitioned to the retracted position. Because the mouthpiece plunger 204 is locked in place in the retracted position (and, thus, immobilized), the compressed spring 205 will expand against and push the supply packet 208 into the puncture device 210, thereby causing the pre-vapor formulation to be squeezed from the pierced supply packet 208.

The supply packet 208 may be pierced during the compression of the spring 205 or when the spring 205 expands against the retracted mouthpiece plunger 204. In the latter situation, the material of the supply packet 208 may be designed to be sufficiently strong to briefly withstand the force associated with the compression of the spring 205 as the mouthpiece plunger 204 is being retracted (e.g., supply packet 208 designed to maintain its structural integrity for about 0.2-0.8 seconds before succumbing to the puncture device 210). In either case, the implementation of the spring 205 permits the mouthpiece plunger 204 to be instantly retracted while allowing the pre-vapor formulation to be released from the supply packet 208 in a more controlled manner. The pre-vapor formulation that is released from the supply packet 208 will be absorbed by the outer absorbent material 212 and the inner absorbent material 214 as well as the wick which is in fluidic communication therewith. During vaping, as the pre-vapor formulation in the wick is heated by the heater structure to generate a vapor, more pre-vapor formulation in the outer absorbent material 212 and the inner absorbent material 214 will be drawn into the wick via capillary action until the supply of pre-vapor formulation is depleted or otherwise insufficient to adequately saturate the wick.

A method of improving a shelf-life of a pre-vapor formulation for an e-vapor device may include arranging a supply packet within a housing shell of the e-vapor device so as to be between a mouthpiece that is secured to an end of the housing shell and a puncture device within the housing shell. The supply packet contains the pre-vapor formulation. The mouthpiece is configured to transition from a protracted position to a retracted position. The puncture device is configured to pierce the supply packet to release the pre-vapor formulation when the mouthpiece transitions to the retracted position.

The method may also include forming the supply packet into an annular form prior to the arranging step. In addition, the method may include hermetically sealing the pre-vapor formulation within the supply packet prior to the arranging. The hermetically sealing step may include heat sealing the pre-vapor formulation within a polymer-coated metal foil. The method may also include pressing the mouthpiece to transition from the protracted position to the retracted position to activate the e-vapor device. The method may further include squeezing the supply packet with a stored energy provided by a compression of a spring so as to discharge the pre-vapor formulation based on a deformation of the supply packet caused by a decompression of the spring.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An e-vapor device, comprising:

a housing configured to receive a supply packet containing a pre-vapor formulation, the housing extending in a longitudinal direction, the housing including a first end and a second end opposite the first end;

a mouthpiece secured to the first end of the housing;

a puncture device within the housing, the puncture device being positioned opposite the supply packet from the mouthpiece;

a spring within the housing between the mouthpiece and the supply packet, the mouthpiece configured to slide in the longitudinal direction and into the housing so as to compress the spring, the spring configured to exert a compressive force on the supply packet in the longitudinal direction to push the supply packet toward the puncture device, the housing, the mouthpiece, and the supply packet defining a central air passage extending from the first end to the second end; and a heater within the housing and configured to heat the pre-vapor formulation to generate a vapor.

2. The e-vapor device of claim 1, wherein the mouthpiece is configured to slide coaxially into the housing.

3. The e-vapor device of claim 1, wherein the mouthpiece is configured to slide so as to reduce a volume of the supply packet.

4. The e-vapor device of claim 1, wherein the mouthpiece is configured to slide toward the heater.

5. The e-vapor device of claim 1, wherein the mouthpiece has a side surface and is configured to transition from a protracted position to a retracted position such that at least a majority of the side surface is obscured from view when the mouthpiece is in the retracted position.

6. The e-vapor device of claim 1, wherein the mouthpiece is configured to slide irreversibly into the housing.

7. The e-vapor device of claim 1, wherein the mouthpiece includes a collar portion and a plunger portion extending through the collar portion.

8. The e-vapor device of claim 7, wherein the collar portion is stationary relative to the housing, and the plunger portion is retractable and configured to slide into the housing to a retracted position.

9. The e-vapor device of claim 8, wherein the plunger portion is configured to lock in place when the retracted position is reached.

10. The e-vapor device of claim 1, wherein the heater is isolated from the pre-vapor formulation until a sliding of the mouthpiece into the housing to activate the e-vapor device.

11. The e-vapor device of claim 1, further comprising:

a chimney within the housing such that an annular space is defined therebetween.

12. The e-vapor device of claim 11, wherein the mouthpiece is configured to slide into the annular space.

13. The e-vapor device of claim 1, wherein the puncture device is configured to pierce the supply packet to release the pre-vapor formulation when the mouthpiece slides into the housing.

14. The e-vapor device of claim 1, wherein the spring is configured to decompress so as to facilitate a discharge of the pre-vapor formulation from the supply packet.

15. The e-vapor device of claim 1, wherein the spring is configured to undergo a decompression as the supply packet undergoes a compression.

16. The e-vapor device of claim 1, further comprising:

a diffuser plate configured to distribute the compressive force over a surface of the diffuser plate.

17. The e-vapor device of claim 1, further comprising:

an absorbent material within the housing, the absorbent material configured to absorb the pre-vapor formulation discharged from the supply packet.

18. The e-vapor device of claim 1, wherein compression of the supply packet in the longitudinal direction causes a discharge of the pre-vapor formulation from the supply packet.

19. The e-vapor device of claim 1, further comprising:

an absorbent material within the housing, the absorbent material including an inner absorbent material and an outer absorbent material wrapped around the inner absorbent material;

wherein the puncture device is configured to be wrapped around the outer absorbent material.

* * * * *